United States Patent [19]

Reynolds

[11] 4,178,063

[45] Dec. 11, 1979

[54] REJECTION TYPE FUSE CLIP ASSEMBLY

[75] Inventor: Howard Reynolds, New Britain, Conn.

[73] Assignee: General Electric Company, New York, N.Y.

[21] Appl. No.: 901,366

[22] Filed: Apr. 28, 1978

[51] Int. Cl.[2] ..... H01K 13/16

[52] U.S. Cl. ..... 339/259 F; 339/186 R

[58] Field of Search ..... 339/252 F, 253 F, 358 F, 339/258 F, 259 F, 262 F, 265 F, 186 R, 186 M; 337/252

[56] References Cited

U.S. PATENT DOCUMENTS

| | | | |
|---|---|---|---|
| 3,890,032 | 6/1975 | Tillson | 339/258 F |
| 3,960,435 | 6/1976 | Bailey | 339/186 R |
| 3,984,801 | 10/1976 | Mrenna et al. | 337/252 |
| 4,017,816 | 4/1977 | Latimer | 339/253 F X |
| 4,097,114 | 6/1978 | Motten, Jr. | 339/259 F |

*Primary Examiner*—Joseph H. McGlynn
*Assistant Examiner*—John S. Brown
*Attorney, Agent, or Firm*—Robert A. Cahill; Walter C. Bernkopf; Philip L. Schlamp

[57] ABSTRACT

A fuse clip assembly includes opposed clamping arms defining a pocket for receiving a fuse terminal ferrule. A rejection member, secured in operative relation with the fuse clip, includes a body arranged transversely of the pocket beyond the clip and three rejector arms extending from the body toward the clip. Two of the rejector arms are situated in opposed, spaced relation immediately above the pocket, while the third rejector arm is situated between the clamping arms beneath the pocket. The arms carry interference portion to obstruct the path of downward or endwise insertion into the pocket of a fuse ferrule not specially keyed with an annular groove.

2 Claims, 3 Drawing Figures

REJECTION TYPE FUSE CLIP ASSEMBLY

BACKGROUND OF THE INVENTION

The present invention relates generally to fuse holders and, more particularly to cartridge fuse holders capable of rejecting improper fuses.

Cartridge fuses are available in a variety of current ratings and interrupting capacities (IC). At least in one case, cartridge fuses of the same current rating but of different interrupting capacity are of substantially the same physical size. Specifically, the current limiting, high IC class R cartridge fuse is essentially identical in physical dimensions to the non-current limiting, low IC class H cartridge fuse. Consequently, the class H and class R fuses are interchangeable insofar as the fuse holder is concerned. Obviously, they are not interchangeable from the standpoint of circuit protection. If a class H fuse is inadvertently inserted in a fuse holder installed in a circuit calling for class R fuse protection, a potentially hazardous situation is created. To discourage this from occurring, industry has resorted to keying one end terminal of the class R fuse and a specially designed rejection fuse holder which accepts the keyed end terminal of a class R fuse but does not accept the unkeyed end terminal of a class H fuse. In the case of class R fuses having ferrule type end terminals, keying is achieved by machining an appropriately dimensioned annular groove in one of the terminal ferrules. The rejection fuse holder is then provided with an interference member which is accommodated in the annular groove of a class R fuse terminal ferrule as it is inserted between the clamping arms. The interference member engages the ungrooved, smooth periphery of a class H fuse terminal ferrule to obstruct its insertion between the clamping arms. Rejection fuse holders of this type are exemplified in U.S. Pat. Nos. 2,943,295; 3,914,005; 3,960,435; 3,984,801 and 4,017,816.

Since both class R and class H fuses are widely used, manufacturers are forced into the uneconomical proposition of having to manufacture and stock both the rejecting and the non-rejecting types of fuse holders. Since the fuse holders are assembled in electrical equipment prior to shipment, the equipment itself must also be stocked or, alternatively, the type of fuses the equipment is to utilize must be known at the time of assembly.

To mitigate the additional manufacturing expense engendered by the necessity of supplying both types of fuse holders, manufacturers have resorted to providing with the equipment a basic non-rejecting type fuse holder capable of accepting both class H and class R cartridge fuses and offering a kit including a rejection member which is physically adapted to the fuse holder by the customer at the time the equipment is installed. Examples of this approach are illustrated in the above cited U.S. Pat. Nos. 3,984,801 and 4,017,816.

It is accordingly an object of the present invention to provide a fuse clip assembly constructed to reliably reject a cartridge fuse whose terminal ferrule is not specially keyed with an annular groove.

Another object of the present invention is to provide a fuse clip assembly of the above character, wherein a rejection member may be readily field installed to convert the fuse clip from a non-rejecting to a rejecting type.

A further object is to provide a rejection type fuse clip assembly which is inexpensive to manufacture and convenient to use.

Other objects of the invention will in part be obvious and in part appear hereinafter.

SUMMARY OF THE INVENTION

In accordance with the present invention, there is provided a fuse clip assembly which includes a fuse clip consisting of a pair of resilient clamping arms upstanding in opposed, spaced relation from a base to define a fuse terminal ferrule receiving pocket. The clip base is bolted in electrical connection with a conductive strap. With the construction thus far summarized, the fuse clip assembly accepts both class H and class R fuse terminal ferrules. To adapt the fuse clip assembly so as to accept only class R fuses having one of their terminal ferrules specially keyed with an annular recess, a rejection member is added to the assembly in a convenient manner conducive to field retrofitting. This rejection member includes an upright body arranged transversely to the pocket beyond the rear of the clip and a foot bent normally of the body for extension into overlapping relation with the clip base. A one-way screw clamps the rejection member foot and clip base to the conductive strap.

Bent at right angles from the rejection member body for extension toward the clip are three rejector arms. Two of these rejector arms are situated in opposed, spaced relation immediately above the pocket, while the third rejector arm is situated between the clamping arms immediately beneath the pocket. The two upper rejector arms terminate in opposed interference portions poised to obstruct the path of downward insertion into the pocket of a fuse terminal ferrule not specially keyed with an annular groove. The lower rejector arm terminates in an upwardly directed interference portion poised to obstruct spurious endwise insertion into the pocket of a fuse ferrule, regardless of whether or not it is equipped with an annular groove. Consequently, attempts to insert an improper fuse in the rejection type fuse clip assembly of the present invention are completely frustrated. That is, once the rejection member is assembled with the fuse clip, its fuse rejecting capability is essentially undefeatable, a prerequisite for Underwriters' Laboratories approval.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Like reference numerals refer to corresponding parts throughout the several views of the drawing.

DETAILED DESCRIPTION

Figure 1:
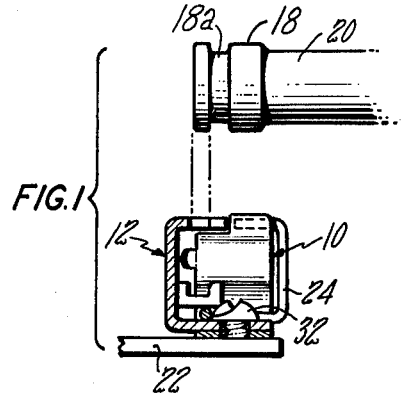
FIG. 1 is a side elevational view, partially broken away, of a rejection type fuse clip assembly of the present invention adapted to accept downward insertion of a class R cartridge fuse terminal ferrule, but rejecting insertion of a class H fuse terminal ferrule lacking a specially keyed annular groove.
Figure 2:
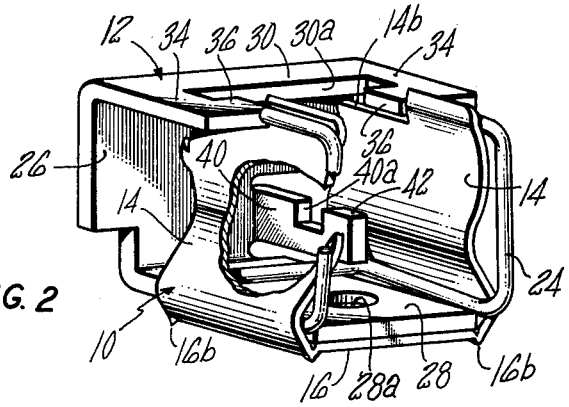
FIG. 2 is an enlarged, perspective view of the rejection type fuse clip assembly of FIG. 1.
Figure 3:
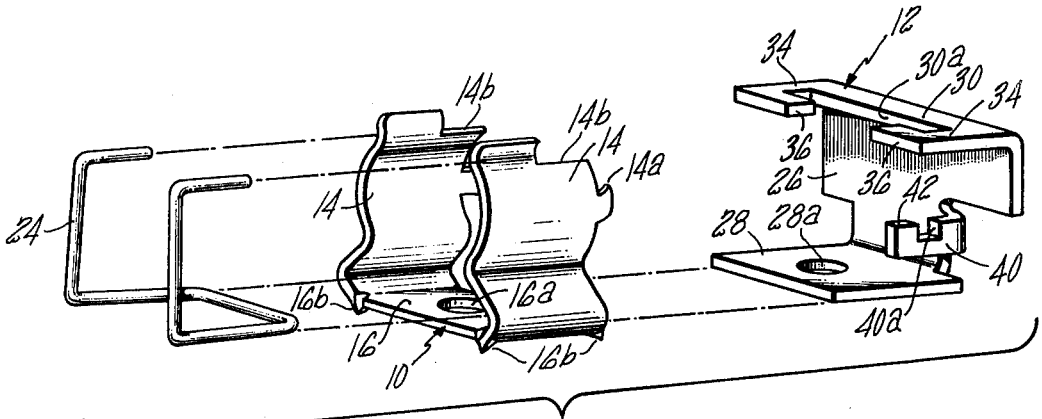
FIG. 3 is an exploded, perspective view of the fuse holder assembly of FIG. 1.

The fuse clip assembly of the present invention, whose overall construction is best seen in FIGS. 2 and 3, includes a fuse clip, generally indicated at 10, and a rejection member, generally indicated at 12. The fuse clip, preferably formed of a highly conductive metal such as copper, includes a pair of upstanding, spaced, generally parallel flexible fuse terminal clamping arms 14 integrally joined by an intermediate base 16. Clamping arms 14 are provided with outwardly bowed portions defining opposed concave contact surfaces for engaging the periphery of an end terminal ferrule 18 of a cartridge fuse 20 (FIG. 1). When fuse clip 10 is used alone, i.e., without rejection member 12, to accommodate the insertion in the pocket defined between its clamping arms of either class R or class H fuse terminal ferrules, a conventional bolt is inserted through a clearance hole 16*a* in clip base 16 into threaded engagement with a tapped bore formed in a terminal strap, such as is illustrated at 22 in FIG. 1, pursuant to clamping the clip in electrical contacting engagement with the terminal strap. A spring 24 is assembled with the fuse clip to act on the clamping arms in a manner to enhance their contact pressure on the fuse terminal ferrule. Barbs 16*b* may be struck from the four corners of the clip base for dependence along the lateral edges of the terminal strap for anti-turn purposes. Moreover, the clamping arms may be provided with inwardly turned tabs 14*a* which serve to engage the end of the fuse terminal ferrule in longitudinally locating the installed position of the fuse.

Rejection member 12, preferably formed of essentially rigid sheet metal stock, is of a generally C-shaped configuration having an upright body 26, a lower, horizontally extending foot 28 and an upper horizontally extending shoulder 30. To accommodate assembly of rejection member 12 to fuse clip 10, foot 28 is provided with a clearance hole 28*a* which is registered with clearance hole 16*a* in underlying clip base 16 to accept insertion of the shank of a one-way headed bolt 32 (FIG. 1) into threaded engagement with the tapped bore in terminal strap 22. It will be appreciated that the one-way bolt effectively prevents disassembly of the rejection member, and thus disassembly of the rejection member to defeat its fuse rejecting capability, as described below, is effectively discouraged. If the rejection member is to be field installed, the conventional bolt clamping the fuse clip to the terminal strap is removed with a screw driver and replaced with a one-way bolt 32 to clamp the clip and rejection member in assembly to the terminal strap.

Extending toward clip 10 from shoulder 30 of rejection member 12 are a pair of parallel, spaced rejector arms 34. The upper rear corners of clip clamping arms 14 are relieved at 14*b* to avoid interference with the extension of the rejector arms. These rejector arms terminate in opposed, inwardly extending interference elements 36 poised immediately above the fuse terminal ferrule receiving pocket defined by clamping arms 14. The spacing between rejector arms 34 is slightly in excess of the outer diameter of the fuse terminal ferrule for either a class R or class H fuse in the ratings the fuse clip is designed to accept. The spacing between the ends of interference elements 36 is slightly in excess of the diameter at the bottom of an annular groove 18*a* (FIG. 1) specially keyed into one fuse terminal ferrule of class R fuses exclusively. It is thus seen that the interference elements 36 will be accepted by annular groove 18*a* as a class R fuse terminal ferrule 18 is inserted along a downward path into the pocket between clip clamping arm. Obviously, normal downward insertion of a fuse terminal ferrule lacking this annular groove 18*a* will be obstructed by the interference elements 36, and thus the insertion of a class H fuse in this manner is effectively rejected.

It is considered possible that the fuse rejecting function of these interference elements 36 can be circumvented or defeated by spurious endwise insertion of a class H fuse terminal ferrule into the pocket from below the level of rejector arms 34. To preclude this devious procedure, the rejection member is equipped with a third rejector arm 40 which extends inwardly from rejection member body 26 into the space between clamping arms 14 at a location generally beneath the fuse clip pocket. This third rejector arm terminates in an interference element 42 which projects generally upward into the fuse clip pocket. This interference element is also accommodated in the annular groove 18*a* in a class R fuse terminal ferrule 18 upon its downward insertion past interference elements 36 into complete acceptance in the fuse clip pocket. However, unlike interference elements 36, interference element 42 is situated to engage the end face of a fuse terminal ferrule and thereby obstruct its endwise insertion fully into the fuse clip pocket. It will be noted that this obstruction is effective, regardless of whether a class H or a class R fuse is involved. Thus, this devious method of fuse installation, which in most cases would be resorted to in a spurious attempt to install a class H fuse in circumvention of interference elements 36, is absolutely precluded. Rejector arm 40 is preferably provided with a shoulder 40*a* which serves with tabs 14*a*, and edge 30*a* of shoulder 30 as aligned end stops for the fuse terminal ferrule 18 of a class R cartridge fuse 20.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. A fuse clip assembly capable of accepting only cartridge fuse terminal ferrules keyed with an annular groove, said assembly comprising, in combination:

A. a fuse clip having a pair of spaced, generally parallel, flexible clamping arms upstanding from an intermediate base, said clamping arms defining therebetween a pocket for accommodating the terminal ferrule of a cartridge fuse;

B. a rejection member having (1) an upright body arranged transversely of said pocket to the rear of said clip, (2) a shoulder bent over from the top of said body for horizontal extension toward said clip and terminating in an end stop edge for locating the longitudinal position of a grooved fuse terminal ferrule in said pocket, (3) a foot extending from the lower end of said body into overlapping relation with said clip base, (4) a pair of rejector arms extending from said shoulder at each side of said end stop edge for disposition immediately above said pocket, (5) an interference element carried at the end of each said rejector arm, said interference elements cooperating to obstruct the downward insertion into said pocket of a fuse terminal ferrule lacking the annular groove, (6) the upper rear corners of said clamping arms being relieved to avoid interference with the extensions of said rejector arm pair and the interference elements borne thereby, (7) an additional rejector arm extending from a lower portion of said body for disposition between said clamping arms generally beneath said pocket, and (8) an additional interference element carried by said additional rejector arm for upward extension into said pocket, said additional interference element obstructing endwise insertion of a fuse terminal ferrule from below the level of said interference elements carried by said rejector arm pair; and C. an essential non-removable fastener clamping said rejection member foot to said fuse clip base and the latter in electrical connection with a conductive terminal strap.

2. The fuse clip assembly defined in claim 1, wherein said additional rejector arm includes a shoulder located rearwardly of said additional interference element, said shoulder serving as an additional end stop for locating the longitudinal position of a grooved fuse terminal ferrule in said pocket.

* * * * *